US009725909B2

(12) United States Patent
Ward

(10) Patent No.: US 9,725,909 B2
(45) Date of Patent: Aug. 8, 2017

(54) GUTTER CLEANING DEVICE AND SYSTEM

(71) Applicant: Gary Lynn Ward, Jacksboro, TN (US)

(72) Inventor: Gary Lynn Ward, Jacksboro, TN (US)

( * ) Notice: Subject to any disclaimer, the term of this patent is extended or adjusted under 35 U.S.C. 154(b) by 0 days.

(21) Appl. No.: 15/246,616

(22) Filed: Aug. 25, 2016

(65) Prior Publication Data

US 2017/0058530 A1 Mar. 2, 2017

Related U.S. Application Data

(60) Provisional application No. 62/210,487, filed on Aug. 27, 2015.

(51) Int. Cl.
*E04D 13/064* (2006.01)
*E04D 13/076* (2006.01)
*E04D 13/04* (2006.01)

(52) U.S. Cl.
CPC ..... *E04D 13/0765* (2013.01); *E04D 13/0641* (2013.01); *E04D 13/0767* (2013.01); *E04D 2013/0413* (2013.01)

(58) Field of Classification Search
CPC . E04D 13/076; E04D 13/064; E04D 13/0767; E04D 13/0725; E04D 13/0765
See application file for complete search history.

(56) References Cited

U.S. PATENT DOCUMENTS 2,701,535 A * 2/1955 Sholl ..... E04D 13/068 405/121
3,225,545 A * 12/1965 Flegel ..... E01C 11/227 404/2
4,407,097 A * 10/1983 Allen ..... E04D 13/076 52/11
4,852,308 A * 8/1989 Papenbrock ..... E04D 13/0765 15/236.04
4,964,247 A * 10/1990 Spica ..... E04D 13/076 52/11
4,998,386 A * 3/1991 Baumgarth ..... E04D 13/064 52/11
5,971,662 A * 10/1999 Becker ..... E03F 3/046 404/2
6,223,474 B1 * 5/2001 Kafton ..... E04D 13/076 210/474
6,293,054 B1 * 9/2001 Cangialosi ..... E04D 13/076 210/474
6,325,085 B1 * 12/2001 Gower ..... E04H 9/14 135/115
7,117,642 B2 * 10/2006 Brown ..... E04D 13/076 248/48.1

(Continued)

*Primary Examiner* — Brian Glessner
*Assistant Examiner* — Daniel Kenny
(74) *Attorney, Agent, or Firm* — Pitts & Lake, P.C.

(57) ABSTRACT

A system and devices to clean a rain gutter include a selectively openable end cap provided at an end of a gutter that is configured to be selectively positionable between a closed state and an open state to access an interior of the gutter, and a plurality of debris collecting members configured fit inside the gutter and to be selectively inserted and removed from the gutter in a sliding manner, wherein each of the debris collecting members is configured to be coupled to another of the debris collecting members such that an entirety of coupled debris collecting members may be moved along the gutter by force applied to one end of the coupled debris collecting members.

11 Claims, 7 Drawing Sheets

(56) References Cited

U.S. PATENT DOCUMENTS

| | | | | |
|---|---|---|---|---|
| 8,656,647 | B2 * | 2/2014 | Bath | E04D 13/076 52/11 |
| 2008/0066390 | A1 * | 3/2008 | Rossi | E04D 13/0645 52/12 |
| 2013/0283707 | A1 * | 10/2013 | Ratajac | E04D 13/076 52/12 |

* cited by examiner

GUTTER CLEANING DEVICE AND SYSTEM

CROSS-REFERENCE TO RELATED APPLICATIONS

This application claims the benefit of U.S. Provisional Patent Application Ser. No. 62/210,487, filed on Aug. 27, 2015, which is incorporated herein in its entirety by reference.

FIELD OF INVENTION

The present general inventive concept relates to a gutter cleaning device and system, and, more particularly, a device and system to increase the convenience of a user when accessing and/or cleaning debris from a gutter.

BACKGROUND

Rain gutters, referred to herein simply as gutters, are common features in most homes and many other buildings for collecting and diverting rainwater away from the roof edge of such buildings. Unfortunately, the gutters are also prone to collecting leaves and other debris that may prevent the gutters from functioning properly. Conventionally, gutters have been provided with top covers called leaf guards to prevent larger debris from entering and collecting in the gutters. Of course, the leaf guards have to have openings, so as to be porous, such that the rain water is able to enter the gutters to be diverted. As such, smaller debris is still able to enter the gutters, and over time the gutter may collect enough such debris that the gutter needs to be cleaned in order to effectively divert the rain water. The leaf guards are typically attached to the gutters such that they are relatively easy to remove for cleaning the area under the leaf guard, but the user cleaning the gutters typically has to move to several different locations on the gutter during such a cleaning, requiring several movements of a ladder and the corresponding climbs up and down the ladder each time.

Many people attempt to clean rain gutters from the roof, which can result in personal injuries from falling. This is due to the person working on an incline at which the person is facing downward, and stretching out over open space to perform the cleaning. It is more advisable to use a ladder to perform the cleaning operation, but to properly clean the gutters one must continually move the ladder along the gutters. It is very time consuming and difficult to constantly ascend the ladder, clean a reachable section of the gutter, descend the ladder, and move a few feet over to repeat the operation. Such a procedure is not only difficult, but every repositioning and climbing of the ladder presents another opportunity for falling or suffering a related injury. Another problem that currently exists is when a person is removing debris by hand, e.g., by dragging a hand through the gutter to collect the debris, the person may encounter sharp edges which may cause cuts and abrasions. This is particularly problematic when working with a metal roof. Also, metal hangers that are fastened through a lip of the gutter can hinder the cleaning process.

Therefore, a device and/or system may be desired that would allow a person to clean the rain gutters while avoiding the problems discussed above, as well as other difficulties. A method that would provide ready access to the interior of the gutters, and avoid much of the ladder repositioning, may prevent many such problems.

BRIEF SUMMARY

According to various example embodiments of the present general inventive concept, a hinged or detachable end cap may be provided to a gutter to allow a user to readily access the interior of the gutter for cleaning and/or other maintenance. In various example embodiments, a debris collecting member configured to fit inside the gutter may be provided such that a user can simply remove the debris collecting member to empty the debris collected therein.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by a rain gutter including a section of gutter configured to collect and divert water, and a selectively openable end cap provided at an end of the section of gutter that is configured to be selectively positionable between a closed state and an open state to access an interior of the section of gutter.

The foregoing and/or other aspects and advantages of the present general inventive concept may also be achieved by a system to clean a rain gutter, including a plurality of debris collecting members configured fit inside a gutter and to be selectively inserted and removed from the gutter in a sliding manner, wherein each of the debris collecting members is configured to be coupled to another of the debris collecting members such that an entirety of coupled debris collecting members may be moved along the gutter by force applied to one end of the coupled debris collecting members.

The foregoing and/or other aspects and advantages of the present general inventive concept may also be achieved by a system to clean a rain gutter, including a selectively openable end cap provided at an end of a gutter that is configured to be selectively positionable between a closed state and an open state to access an interior of the gutter, and a plurality of debris collecting members configured fit inside the gutter and to be selectively inserted and removed from the gutter in a sliding manner, wherein each of the debris collecting members is configured to be coupled to another of the debris collecting members such that an entirety of coupled debris collecting members may be moved along the gutter by force applied to one end of the coupled debris collecting members.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of various example embodiments, with reference to the accompanying drawings in which.

DETAILED DESCRIPTION

Figure 1:
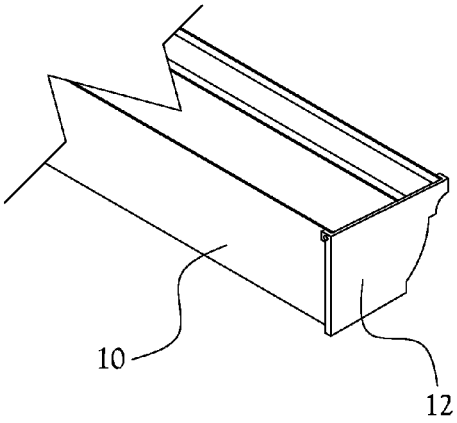
FIGS. 1-2 illustrate a hinged end cap for a gutter according to an example embodiment of the present general inventive concept.

Reference will now be made to the example embodiments of the present general inventive concept, examples of which are illustrated in the accompanying drawings, illustrations, and photographs. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a hinged or detachable end cap may be provided to a gutter to allow a user to readily access the interior of the gutter for cleaning and/or other maintenance. According to other various example embodiments of the present general inventive concept, a debris collecting member configured to fit inside the gutter may be provided such that a user can simply remove the debris collecting member to empty the debris collected therein. The debris collecting member may be configured to rest inside the gutter, fitting under a conventional leaf guard, when not being removed by a user during a debris removal operation. The end cap and debris collecting member may be used separately or in conjunction with one another in a gutter cleaning system. When provided with features such as these, a user may be able to remain in one safe spot, such as on a secured ladder, and effectively clean an entire length, or at least a substantial length, of a gutter from that one spot. An added benefit of the present general inventive concept is that these features can be utilized with most contemporary gutters and leaf guards, so retro-fitting is not a problem.

With typical conventional gutter systems, a closed end of the gutter is permanently closed with a fixed cap. According to an example embodiment of the present general inventive concept, a detachable or openable end cap may be provided such that a user can easily remove, or otherwise open, the end cap to access the interior of the gutter. In various example embodiments, the cap may be completely removable from the gutter. In other example embodiments, the cap may be coupled in a hinge fashion at one or more points to the gutter, so that a user may open the end cap without fear of losing or otherwise mishandling the end cap. According to various example embodiments of the present general inventive concept, the end cap may be selectively positionable between an open and closed state. Such an end cap is described herein as being selectively openable, which indicates that the end cap may be readily and easily opened and closed by a user, and without damage, deformation, etc., to the gutter or end cap. According to different example embodiments of the present general inventive concept, the selectively openable end cap may be completely removed from the gutter, or be fixed at one or more points to the gutter in, for example, a hinged arrangement, or be tethered to the gutter to maintain a hands-free connection when in the open state, and so forth.

Figure 2:
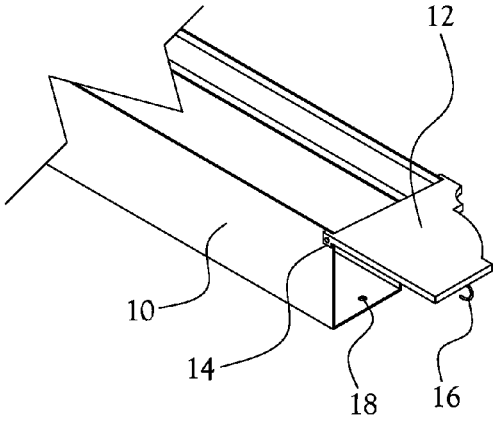

FIGS. 1-2 illustrate a hinged end cap for a gutter according to an example embodiment of the present general inventive concept. FIG. 1 illustrates an end portion of the gutter 10 provided with the hinged end cap 12 in a closed state, and FIG. 2 illustrates the hinged end cap 12 in an open state. As can be seen in the illustration of FIG. 2, a user is afforded easy access to the interior of the gutter 10 due to the open state of the end cap 12. Although not illustrated in FIGS. 1-2, a leaf guard would be typically be provided to the top open portion of the gutter 10, which makes the opening created by the end cap 12 in FIG. 2 so convenient for the user. As illustrated in FIG. 2, the end cap 12 may be connected in a hinge fashion to two points 14 of the gutter 10. In other example embodiments, the end cap may be hinged as a single point, or more than two points. In various example embodiments, the end cap 12 may be configured to compress the hinge points 14 of the gutter 10 from the outside, or press outward on the hinge points 14 from the inside, so as to hinder free hinging movement of the end cap 12 such that the end cap may remain in the open position without the user having to hold the end cap 12 in such a position. In various example embodiments, other securing methods and/or devices may be provided to hold the end cap 12 in the open position during a gutter cleaning operation. The hinged end cap 12 of FIG. 2 is provided with a hook 16 and eye 18 type of fastener to maintain the end cap in a closed state when closed. Such an eye 18 portion may be simply formed in the gutter 10 itself, perhaps with a gasket or other leak-limiting engagement for the hook 16, or added to a surface of the gutter 10 so as to not provide another point for potential leakage. As illustrated in FIG. 2, the hinged portion 14 is at the top of the end cap 12, the hook 16 is provided at the bottom of the end cap 12, and the eye 18 to receive the hook 16 is provided in the end of the gutter 10. However, it is understood that a host of different configurations for the hinges and/or closing assemblies/placements may be used in different example embodiments of the present general inventive concept. In various example embodiments, a hook or other connecting member may be hinged to move in a reciprocal manner when opening or closing the end cap, may be rigid and biased such that a small force is applied by the user to open and close the end cap, etc. One skilled in the art will recognize that a variety of assemblies may be employed to hold the end cap in a closed position without departing from scope of the present general inventive concept. The end cap 12 may be provided with a gasket, such as a rubber gasket, to form a watertight seal between proximate surfaces of the end cap 12 and gutter 10 when the end cap 12 is in a closed state. Alternatively, or also, the gutter 10 may be provided with such a gasket. In various example embodiments, the end cap 12 may be secured to the gutter 10 by one or more indentations provided to the gutter 10 and/or the end cap 12 to secure the closure of the end cap 12 due to frictional resistance to movement, rather than a fastener assembly such as the hook 16 and eye 18 illustrated in FIG. 2. Such indentations may be provided on the gutter 10 and the end cap 12 in corresponding locations, one of the pair being concave and the other being convex relative to the proximate surfaces of the gutter 10 and end cap 12. In other various example embodiments, a gasket provided to the end cap 12 or gutter 10 may be used as the fastener assembly to secure the end cap 12 in the closed state. For example, a gasket provided to the end cap 12 may have a resilient receiving portion to receive the end edge of the gutter 10 in a snug fit, a male/female gasket arrangement provided to the gutter 10 and end cap 12, on oversized gasket provided to the end cap 12 that must be forceably fit into the interior of the end of the gutter 10, and so on. As previously described, the end cap 12 may be completely detachable without a hinged connection in various example embodiments, and may be secured to the gutter 10 in a number of ways, such as, for example, any of the methods discussed herein. As used in this description, the term "detachable" indicates that the end cap 12 is readily removable without overly strenuous effort or damage to any of the articles. Thus, the end cap 12 is configured to be readily taken on and off the end of the gutter 10 without cutting or otherwise undue deformation of the end cap 12 or gutter 10. In various example embodiments, an existing gutter 10 can be modified to include such a selectively openable end cap 12, according to methods encompassed by the present general inventive concept. For example, an existing end of the gutter can be removed by a rotary cutting tool, snips, or the like, and a new selectively openable end cap be provided to the newly opened end of the gutter. As another example, the removed end of the gutter can itself be modified to operate as described herein, so that the cutting and/or other various damages are not repeated in subsequent openings of the end cap.

According to an example embodiment of the present general inventive concept, one or more debris collecting members may be provided that are configured to fit inside the gutter and be easily removed to eliminate the debris from the gutters. In various example embodiments, such a debris collecting member may be substantially the same length as a given length of gutter that is to receive the debris collecting member. In other various example embodiments, a plurality of debris collecting members may be configured so as to couple to one another such that an entire length of the connected members may be pulled out of the gutter and disconnected one member at a time.

According to various example embodiments of the present general inventive concept, the debris collecting members may be configured to rest on and/or proximate all surfaces of the gutter that are adjacent to the debris collecting members. In other example embodiments, the debris collecting members may be configured to have substantially less cross-sectional area than a corresponding portion of the gutter. In various example embodiments, at least a portion of the debris collecting members may be porous so as to allow liquid to pass through to the gutter surface. In other various example embodiments, the debris collecting members may be formed of solid surfaces that function similarly to the gutter itself. Various other example configurations are possible within the scope of the present general inventive concept, some of which are described below.

Figure 3:
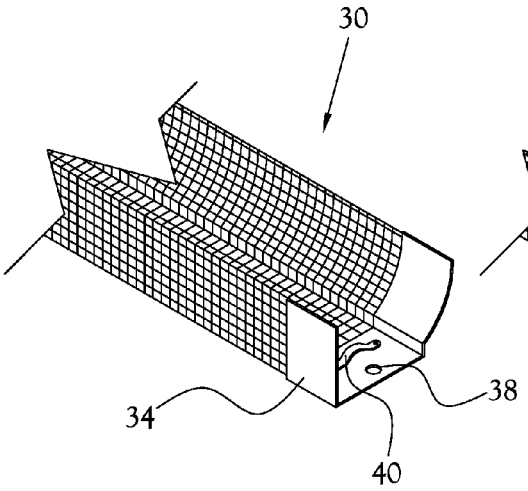
FIGS. 3-4 illustrate opposite ends of a debris collecting member according to an example embodiment of the present general inventive concept.
Figure 4:
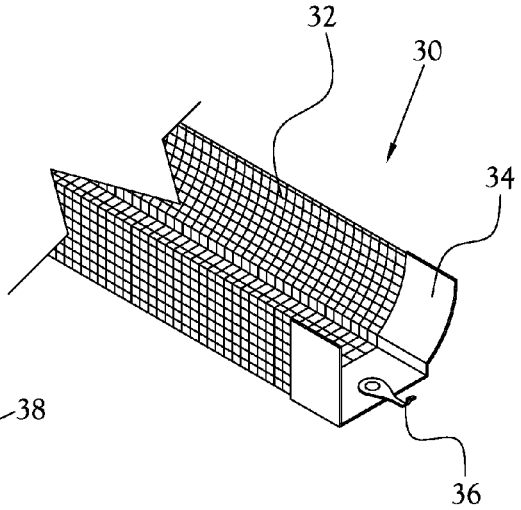

FIGS. 3-4 illustrate opposite ends of a debris collecting member according to an example embodiment of the present general inventive concept. The debris collecting member 30 of FIGS. 3-4 may be configured as a rigid structure that is formed substantially as a porous mesh 32. The size of the openings of the mesh 32 may vary according to desired drainage and/or other factors. In various example embodiments, such a mesh 32 may only be provided in portions of the bottom surface, or only in one or more side surfaces. In other example embodiments, different openings such as slotted openings may be provide on one or more surfaces to allow flow of liquid while retaining most or all of the debris entering the debris collecting member 30. The debris collecting member 30 of FIGS. 3-4 have solid portions 34 at the ends, which may better facilitate the integration of a coupling assembly to couple a plurality of debris collecting members 30 to one another. As illustrated in FIG. 4, a hook 36 is provided to one end of the debris collecting member 30, and, as illustrated in FIG. 3, an eye 38 configured to receive the hook 36 is provided to the other end of the debris collecting member 30. In the example embodiment illustrated in FIGS. 3-4, the end of the debris collecting member 30 having the hook 36 provided thereto may be mated with the opposite end of another debris collecting member 30 by moving the hook 36 through the eye 38. Then, once the two debris collecting members 30 are laid on a flat surface, or otherwise common plane, the upward pointed end of the hook 36 abuts against the edge of the eye 38 and causes the coupled debris collecting members 30 to move as one. Several different methods and/or devices may be used to couple two of the debris collecting members 30 without departing from the scope of the present general inventive concept. Thus, a user may couple a plurality of the debris collecting members 30 together so as to easily slide the coupled debris collecting members 30 through a given section of gutter from one end of the gutter. As illustrated in FIG. 3, the debris collecting member may also be provided with a handle portion 40 to facilitate the handling of the debris collecting members 30 when inserting/removing them into/out of the gutter. The debris collecting member 30 of FIGS. 3-4 is configured to be rigid and have substantially the same shape as the interior of the gutter in which it is designed to be inserted, but other example embodiments may have different configurations. In other words, the debris collecting member 30 of FIGS. 3-4 may rest in contact with the gutter in regard to all portions that are immediately adjacent the gutter, in order to leave little or no space for debris to collect between the debris collecting member 30 and the gutter.

While the example embodiment of the debris collecting member 30 illustrated in FIGS. 3-4 is configured with hook 36 and eye 38 coupling portions for easy coupling with other like configured debris collecting members 30, a host of other types of coupling portions may be provided within the scope of the present general inventive concept. For example, a receiving portion provided at one end of the debris collecting member may extend so as to fit over and receive a boss provided in a corresponding opposite end of another debris collecting member. In various example embodiments, the coupling assembly may be configured such that the connection will not be broken when a plurality of coupled debris collecting members are pushed or pulled along a substantially horizontal plane, but may be readily disconnected when one member is lifted or lowered to a certain angle above or below that plane. According to various example embodiments of the present general inventive concept, the debris collecting members may be of a number of predetermined lengths, such as, for example, three feet. In such an example embodiment, the debris collecting member that is to be positioned the farthest from the access point of the gutter, e.g., the removable end cap 12, may be cut or otherwise shortened to fit the desired space, since there will be no need for the coupling portion at the distal end of the last connected debris collecting member. Also, while the debris collecting members described thus far are configured to have open ends, other various example embodiments may be configured to have closed ends, and the coupling portion and/or handles may be located at the top, bottom, or either side of the closed ends, resulting in a configuration that resembles a linked chain of individually formed baskets. In still other example embodiments, a debris collecting member may be provided with one closed end, such that the particular member with the closed end can serve as an end member on a long chain of coupled debris catching members. This could be beneficial, for example, when a length of gutter is so long that a user may want to provide linked debris catching members from either end of the length, and therefore the linked members will have closed members where the end members meet in the middle. A closed end may also be beneficial when only a relatively short length of linked members are used, so that any collected debris is not lost out of an open end when the members are being pulled out of the gutter.

Figure 5:
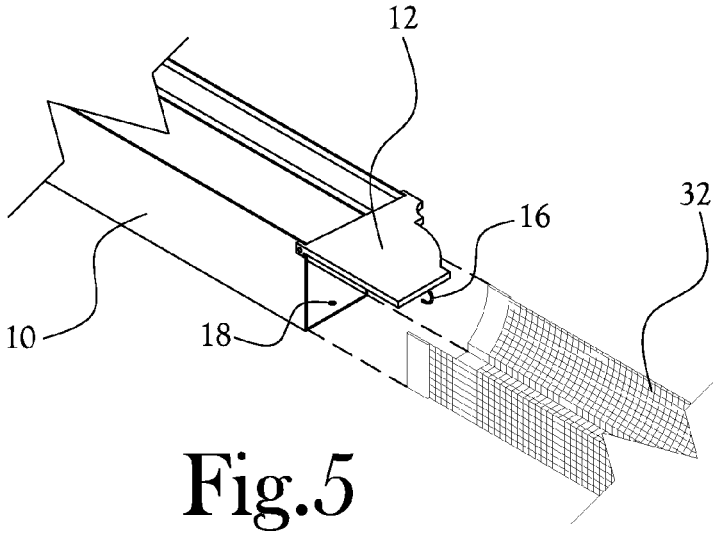
FIG. 5 illustrates the debris collecting member of FIGS. 3-4 being inserted into a gutter according to an example embodiment of the present general inventive concept.

FIG. 5 illustrates the debris collecting member 30 of FIGS. 3-4 being inserted into a gutter according to an example embodiment of the present general inventive concept. In this example embodiment, the gutter 10 of FIGS. 1-2 provided with the hinged end cap 12 is used to illustrated the debris collecting member 30 insertion process. It is noted that the leaf guard has been omitted from FIGS. 1-2, 5-7, and 9-10 for ease of viewing the relationship between the gutter and the end cap and/or debris collecting members. In situations in which such a leaf guard is not installed, or is removed at the time of insertion of the debris collecting members 30, the debris collecting members may be inserted into the gutter 10 through the open top of the gutter 10. In FIG. 5, the hinged end cap 12 has been opened, which allows a user to simply slide a first debris collecting member 30 into the gutter 10. Although the debris collecting member 30 of FIG. 5 is shown with an open distal end, a closed end may be provided to serve as an extra catcher to prevent loss of debris when the members are removed. In various example embodiments, such a closed end debris collecting member may be formed with the closed end at a distal end. In other various example embodiments, an end cap may be affixed to the distal end of the debris collecting member 30 in a variety of coupling methods/arrangements.

Figure 6:
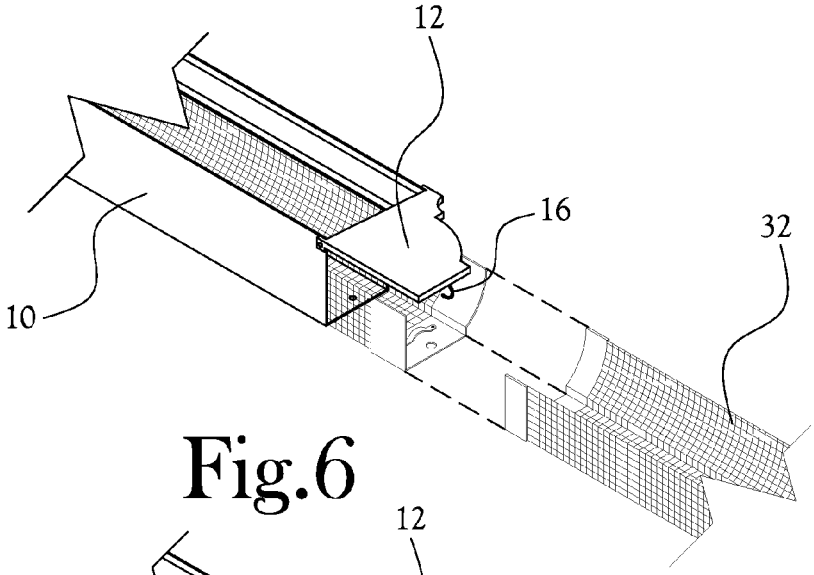
FIG. 6 illustrates a coupling of the debris collecting member of FIG. 5 with another debris collecting member having the same configuration.

FIG. 6 illustrates a coupling of the debris collecting member 30 of FIG. 5 with another debris collecting member 30 having the same configuration. Before the first debris collecting member 30 is pushed completely into the gutter 10, a second debris collecting member 30 may be coupled to the first member 30, and can then be used to push the first member 30 further into the gutter 10. As previously described, in various example embodiments of the present general inventive concept the coupling portions may be configured such that the debris collecting members need to be angled relative to one another to connect and disconnect, so that the debris collecting members do not become uncoupled during a sliding operation into or out of the gutter 10. This process can be repeated until the gutter is full, or until a desired length of the coupled debris collecting members 30 is achieved. When the desired number of debris collecting members 30 have been coupled and installed in the gutter 10, the end cap 12 of the gutter 10 may be closed, and the gutter 10 continues to function in a normal manner. To remove the debris collecting members 30 from the gutter 10, the process illustrated in FIGS. 5-6 is simply reversed. The user is able to use a ladder or other such device to position the user at the end of the gutter 10, and will be able to clean out an entire section of the gutter 10 from that single vantage point. The user will begin by opening the end cap 12, and pulling/sliding the debris collecting member 30 positioned adjacent to the end cap 12 until that debris collecting member 30 is out, or nearly out of the gutter. Then, by angling the debris collecting member 30 to uncouple the member from the next debris collecting member 30, the user is able to dump the debris collected in the removed member 30 and set it aside until the cleaning operation is done. In various example embodiments in which the handle 40 is provided to the debris collecting members 30 as illustrated in FIG. 3, the user is provided a convenient way to handle the debris collecting members 30 during the sliding operations into and out of the gutter 10. In various example embodiments, the debris collecting members 30 may be configured so as to be nested in one another to provide the user a convenient way of storing the debris collecting members 30 during assembly and/or disassembly. For example, the stackable debris collecting members 30 may be stacked in a nested manner, one on top of another, on the top surface of the ladder upon which the user stands.

Figure 7:
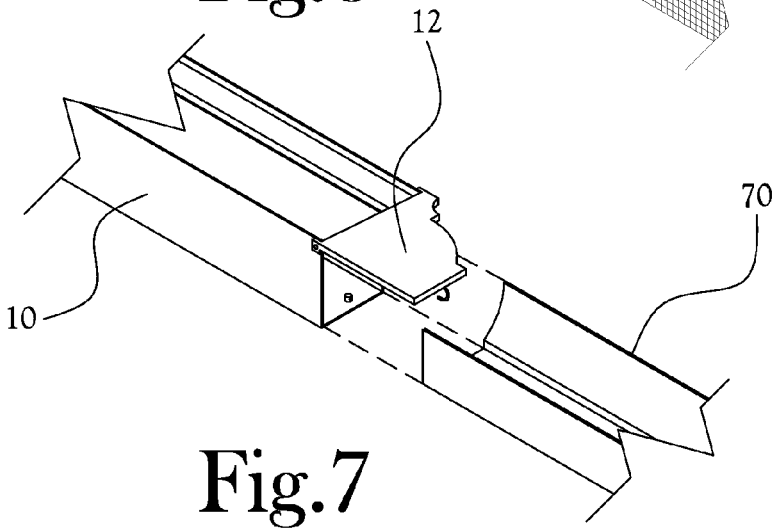
FIG. 7 illustrates a debris collecting member according to another example embodiment of the present general inventive concept.

FIG. 7 illustrates a debris collecting member according to another example embodiment of the present general inventive concept. In the example embodiment of FIG. 7, the debris collecting member 70 is configured so as to have solid surfaces throughout, and therefore will operate in much the same fashion as the gutter 10 itself. Such a configuration may be desirable in an environment in which the debris is so fine that a porous debris collecting member may be less desirable.

Figure 8:
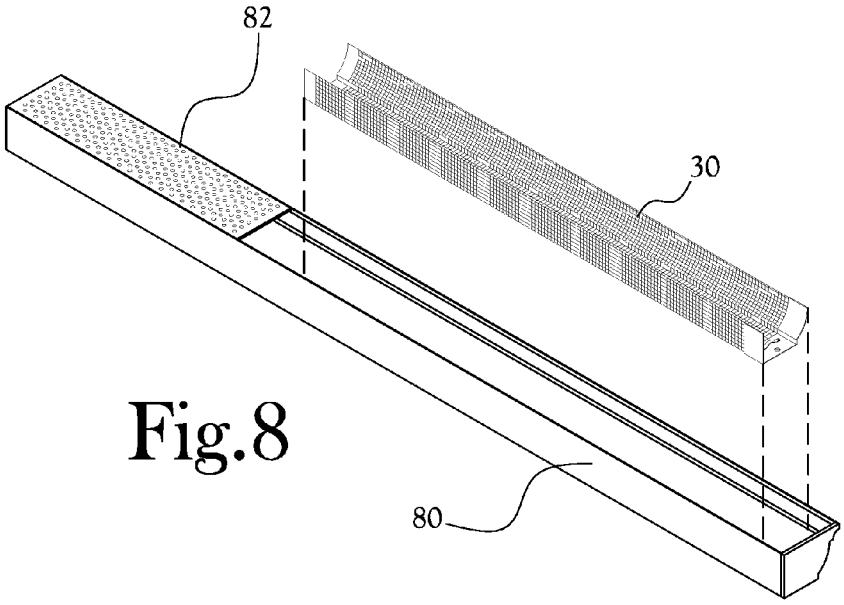
FIG. 8 illustrates another method of inserting the debris collecting member into a gutter according to another example embodiment of the present general inventive concept.

While the example embodiments illustrated in FIGS. 5-7 show the selectively openable end cap 12 used in conjunction with the debris collecting members 30, a user may wish to use the debris collecting members without such an end cap 12. FIG. 8 illustrates another method of inserting the debris collecting member 30 into a gutter 80 according to another example embodiment of the present general inventive concept. In the example embodiment illustrated in FIG. 8, a user has simply removed a section of the leaf guard 82 near the end of the gutter 80, and then may insert the debris collecting member 30 through the top opening of the gutter 80. Coupling the debris collecting members 30 may be done in much the same fashion as that shown in FIGS. 5-6. The user may simply couple the next debris collecting member 30 to be inserted into the gutter 80 to the debris collecting member 30 that may already be at least partially positioned in the gutter, and uses the most recently added member 30 to push the other coupled members 30 through the gutter 80. Once the desired length of debris collecting members 30 has been reached, the user can simply replace the leaf guard 82. Thus, as with the operations involving the openable end cap, a user is able to perform the inserting and/or removing of the debris collecting members 30 from one spot, and avoids having to move the ladder and ascend/descend the ladder multiple times to clean the gutter.

As previously described, in order to clean out the debris collected by the debris collecting members 30, a user simply has to reverse the process described in regard to FIGS. 5-6 or FIG. 8. In regard to the method illustrated in FIGS. 5-6, the user would open the end cap 12 and pull the linked debris collecting members 30 out of the opening one by one, using the handle 40 provided at the end of the members 30 for added convenience, and empty the respective members 30 upon uncoupling. Similarly, in regard to the method illustrated in FIG. 8, the user would remove the same portion of the leaf guard 82 that was removed to install the debris collecting members 30, and proceed to pull the members 30 out one at a time to clean out the debris. After cleaning, the debris collecting members 30 can be reinserted into the gutter 80 to begin the debris collecting process anew.

Just as the debris collecting members 30 may be utilized without the selectively openable end cap 12, in various example embodiments the selectively openable end cap 12 may be utilized without the debris collecting members 30. A user may simply wish to open the selectively openable end cap 12 and access the interior of the gutter 10 with a tool that may be inserted and then removed to rake out debris collected in the gutter 10. For example, a long clearing tool having some sort of scraping or clearing distal end could be inserted into the opening created by opening the selectively openable end cap 12 until the end of the gutter has been reached, and the user could then drag the distal end of the tool along the floor of the gutter to pull the debris out of the end of the gutter 10. Such a clearing tool could have a distal end that pivots in such a way that the clearing action is not engages as the tool is being inserted, but moves to a clearing position when being dragged outward.

Figure 9:
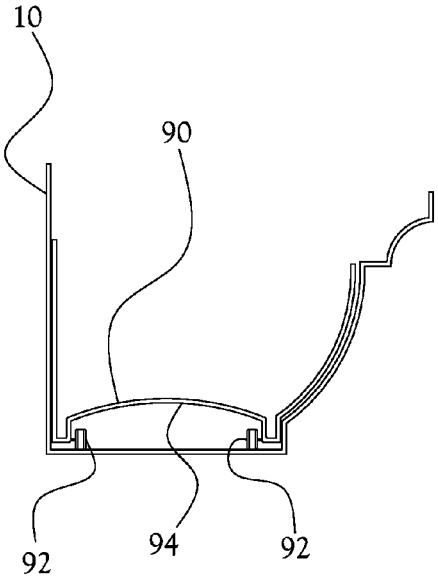
FIG. 9 illustrates an end view of a debris collecting member according to still another example embodiment of the present general inventive concept.

A host of different configurations of the debris collecting members may be provided according to different example embodiments of the present general inventive concept. For example, FIG. 9 illustrates an end view of a debris collecting member according to still another example embodiment of the present general inventive concept, in which the debris collecting member 90 has a bottom surface that is configured so as to leave a space between a bottom portion of the debris collecting member 90 and a bottom inner surface of the gutter 10. Such a configuration may facilitate more efficient draining of liquid through the gutter 10 when debris has begun to fill the debris collecting members 90, particularly when the debris collecting members 90 are porous. Additionally, as shown in FIG. 9, the debris collecting members 90 may be provided with one or more wheels 92 or other portions that ease the sliding of the members 90 into and out of the gutter 10. In the example embodiment illustrated in FIG. 9, an arch 94 has been provided to the bottom surface of the debris collecting member 90, and a plurality of wheels 92 have been provided in the space created by the arch 94. Various example embodiments of the members 90 may be provided with different numbers and/or configurations of the wheels 92, such as one or two wheels 92 at one or both ends of the debris collecting members 90, at locations between the ends of the debris collecting members 90, etc. However, different example embodiments may have such an open space creating configuration without the wheels 92. Likewise, different example embodiments may be provided with wheels or other devices to assist in the sliding without creating such a pronounced open space. While the debris collecting member 90 illustrated in FIG. 9 is shown as fitting in a substantially precise manner in the gutter 10, it is understood that various example embodiments of the present general inventive concept may be formed in a universal configuration to fit in many different styles of gutters.

Figure 10:
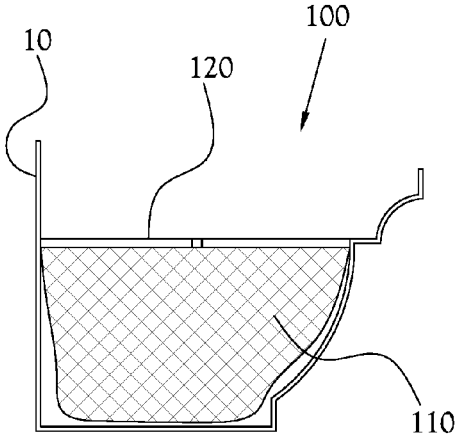
FIG. 10 illustrates an end view of a debris collecting member according to yet another example embodiment of the present general inventive concept.

FIG. 10 illustrates an end view of a debris collecting member according to yet another example embodiment of the present general inventive concept. In the example embodiment illustrated in FIG. 10, the debris collecting member 100 is formed of a pliable mesh material 110 connected to a rigid, rectangular top frame 120. The rigid frames 120 of such configured debris collecting members 100 help to hold a position of the members 100 inside the gutter 10, and may be provided with the coupling portions to allow coupling between a plurality of debris collecting members 100 as previously described. Such a configuration may be chosen to reduce construction costs and/or weight of the debris collecting members 100. In other various example embodiments of the present general inventive concept the debris collecting members may be provided with protrusions that fit over at least one upper edge of the gutter, so that the debris collecting members may be suspended from the top of the gutter and/or be guided by the top of the gutter during a sliding action to install and remove the debris collecting members. Such a configuration may be more practical in an application in which leaf guards are not also present in the gutter system.

Figure 11:
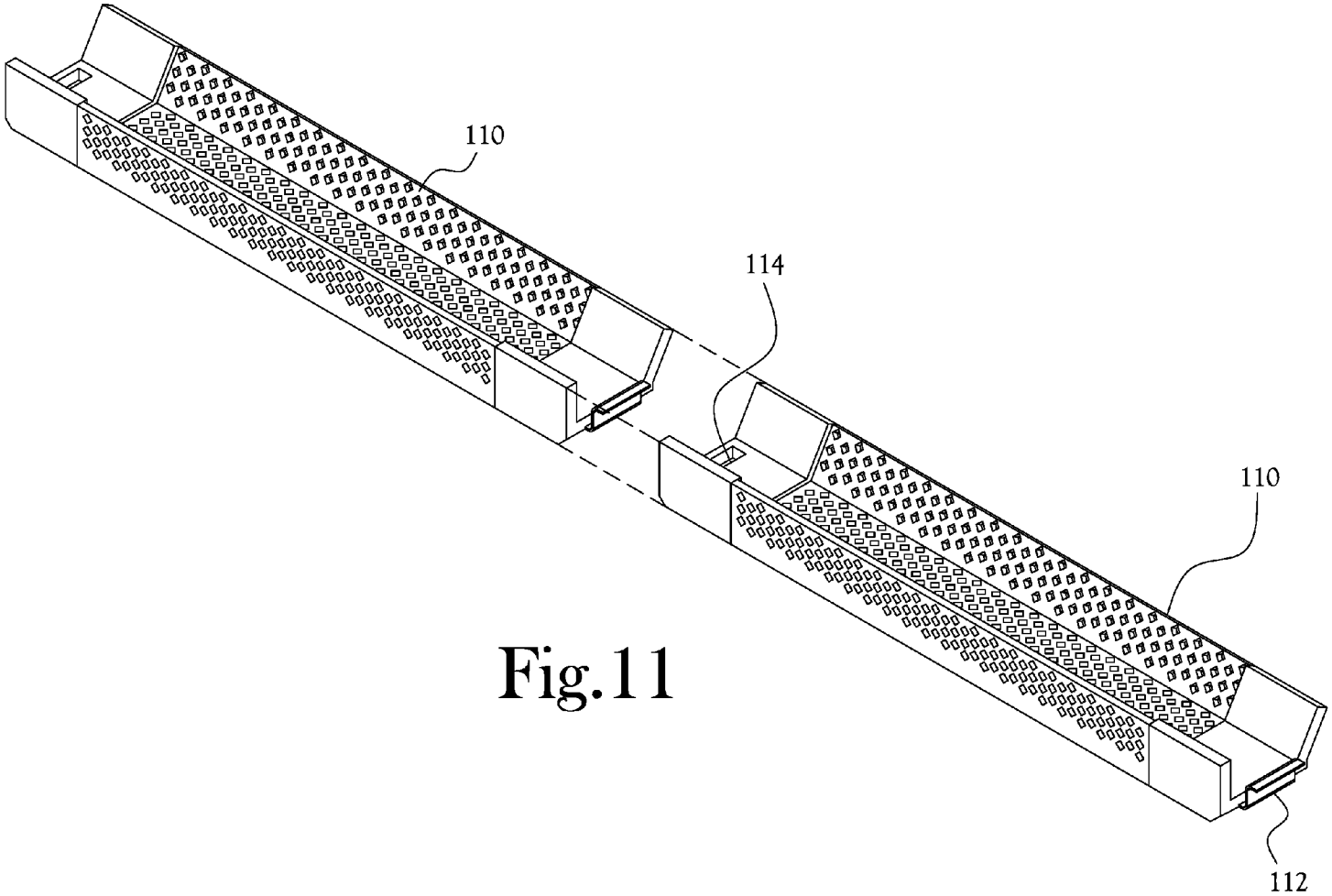
FIGS. 11-12 illustrate a debris collecting member according to yet another example embodiment of the present general inventive concept.
Figure 12:
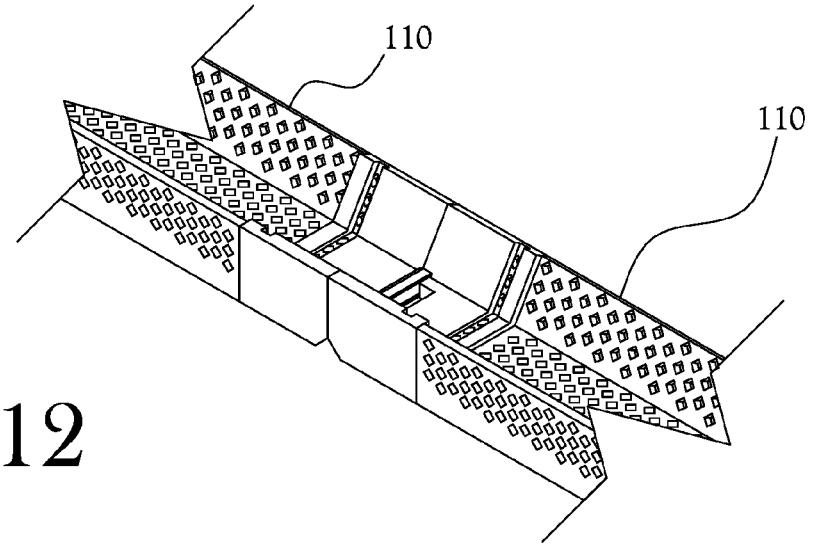

FIGS. 11-12 illustrate a debris collecting member according to yet another example embodiment of the present general inventive concept. In the example embodiment illustrated in FIGS. 11-12, the debris collecting member 110 is formed of a rigid material having a bottom and two side portions configured similar to the gutter 10 in which the debris collecting member 110 will be provided. The debris collecting member 110 is provided with a male coupling portion 112 at one end, and a female coupling portion 114 at the opposite end, so that a plurality of the debris collecting members 110 may be easily coupled together and taken apart when being installed/removed in/from the gutter 10. As illustrated in FIGS. 11-12, the male coupling portion 112 extends horizontally from the end of the debris collecting member 110, then turns upward, and then turns again outward from the debris collecting member 110. Such an arrangement facilitates an easy and secure operation of coupling the members 110 together, and also taking them apart. FIG. 11 illustrates the debris collecting members 110 in an uncoupled state, and FIG. 12 illustrates the members 110 in a coupled state to form a longer section of debris collection. The example embodiment of the debris collecting member 110 illustrated in FIGS. 11-12 is made porous by having a plurality of holes formed in the bottom and side surfaces, such that liquid may easily flow through to the gutter, while debris is contained within the debris collecting member 110. Other various example embodiments may provide drainage holes in different locations and/or patterns, such as, for example, only on the bottom portion of the debris collecting member 110. Additionally, while the example embodiment illustrated in FIGS. 11-12 illustrate the drainage holes as stopping at a given length from each end of the debris collecting member, such drainage holes may be provided in a host of different configurations, such as, for example, from end to end of the debris collecting member 112.

Figure 13:
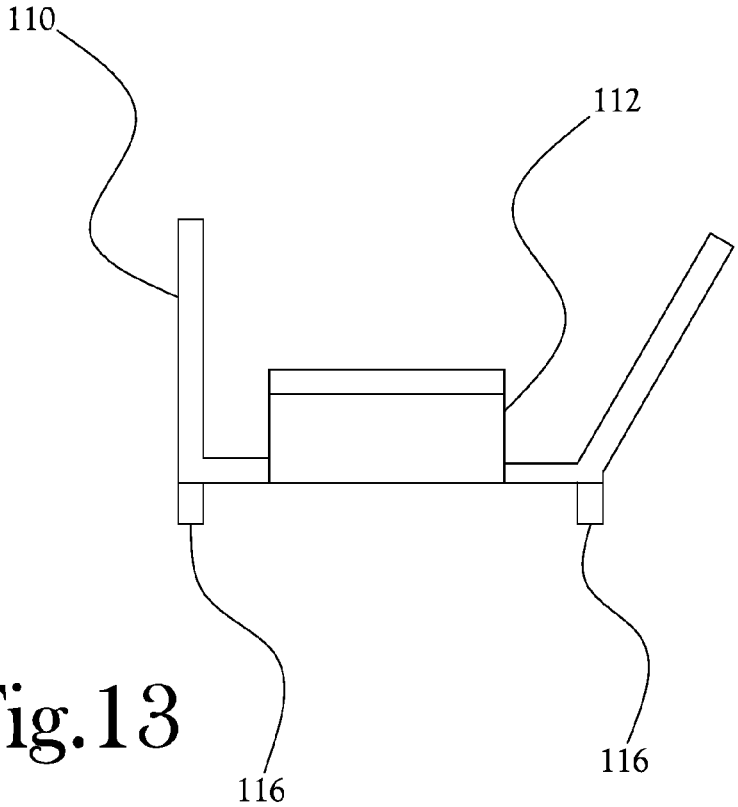
FIG. 13 illustrates an end view of the debris collecting member of FIGS. 11-12.

FIG. 13 illustrates an end view of the debris collecting member of FIGS. 11-12. As illustrated in FIG. 13, protrusions 116 are provided to the bottom portion of the debris collecting member 110 to provide clearance between the bottom portion of the debris collecting member 110 and the inner surface of the gutter 10. Such an arrangement may facilitate easier flow of liquid through the gutter 10, and also allows easier installation/removal of the debris collecting members 110 from the gutter due to the protrusions 116 acting as runners that decrease surface contact between the gutter 10 and the bottom portion of the debris collecting member 110. The runner protrusions 116 in this example embodiment are tapered at the ends, as illustrated in FIGS. 11-12, so as not to interfere with the runner protrusions 116 of the adjacent member 110 during coupling/uncoupling operations. Although the runner protrusions 116 are shown as two continuous rails formed along substantially the entire length of the debris collecting members 110 in FIGS. 11-13, other various example embodiments of the present general inventive concept may be formed with different numbers and/or configurations of runners 116. For example, fewer or more rails may be provided to the bottom portion or side portions of the debris collecting members 110, staggered/interrupted protrusions may be provided along the length of the debris collecting members 110, and so on. Such runner protrusions may be in the form of short rails, studs, or other configurations that serve to create space between the debris collecting member 110 and a surface of the gutter 10. In various example embodiments, the runner protrusions may only be provided on the side portions of the debris collecting members so as not to interfere at all with the runoff of water beneath the bottom surface of the debris collecting member. In various example embodiments of the present general inventive concept, the runner protrusions may be formed integrally with the debris collecting member, and in other various example embodiments the runner protrusions may be formed separately and adhered to the debris collecting members by a host of methods such as, for example, adhesives, screws, and the like.

Figure 14:
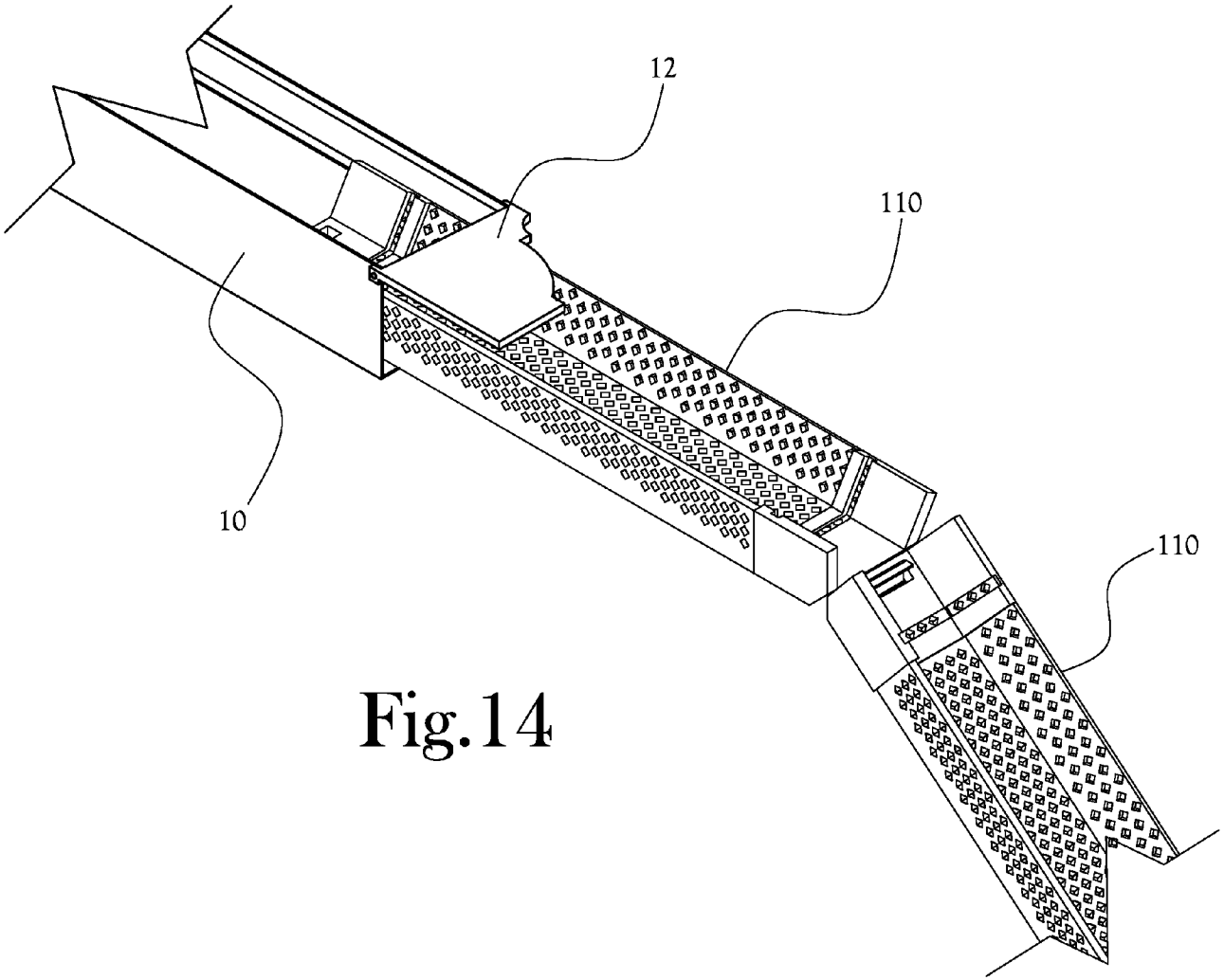
FIG. 14 illustrates a coupling operation using the debris collecting members of FIGS. 11-13.

FIG. 14 illustrates a coupling operation using the debris collecting members of FIGS. 11-13. As illustrated in FIG. 14, the female coupling portion 114 of one debris collecting member 110 may be slipped over the male coupling portion 112 of another debris collecting member 110 by orienting the debris collecting member 110 with the female coupling portion 114 to match the path of the form of the male coupling portion 112 to which the female coupling portion 114 is being mated. The mating operation is simply reversed to separate the debris collecting members 110 during a cleaning procedure.

Figure 15:
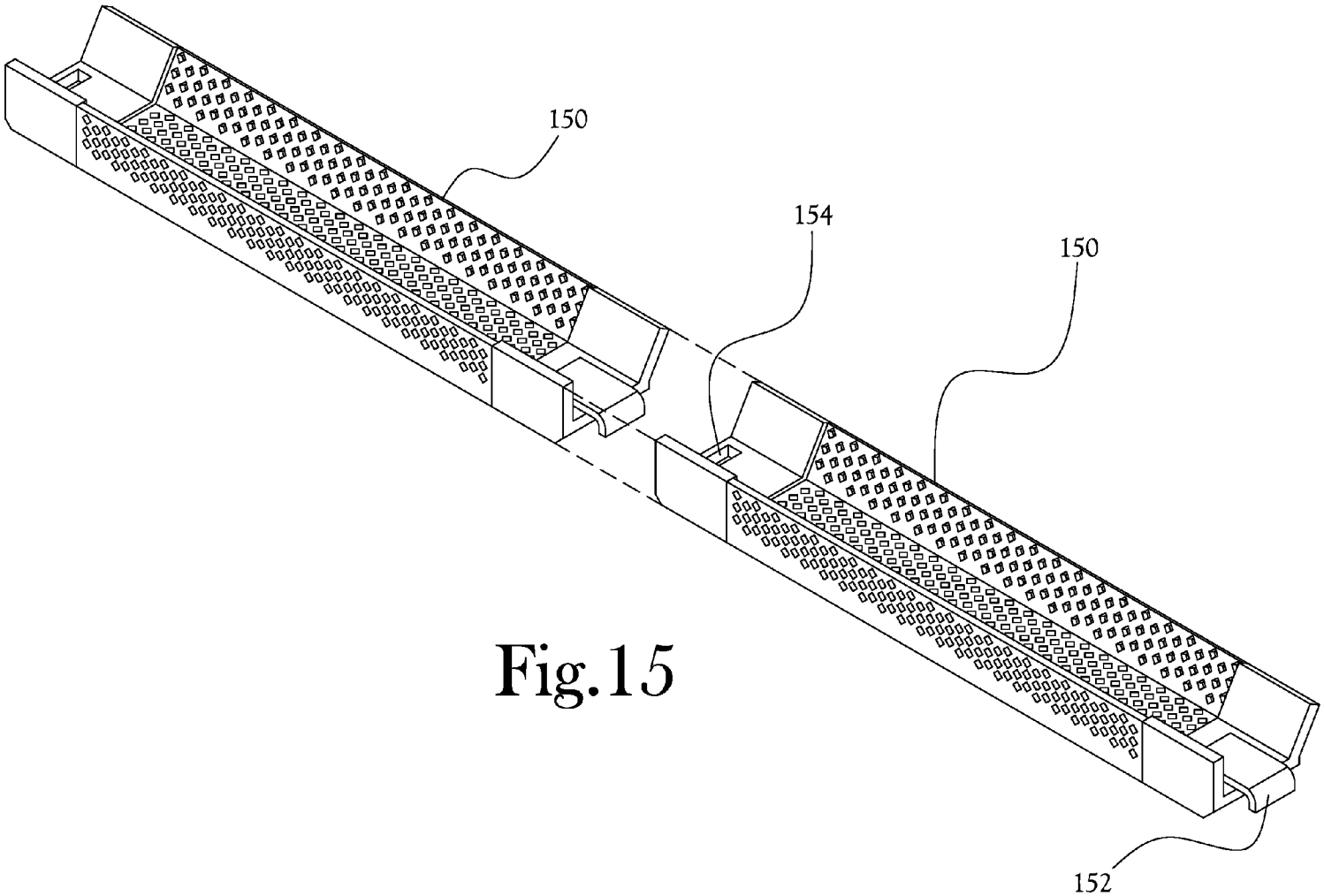
FIG. 15 illustrates a debris collecting member according to still another example embodiment of the present general inventive concept.

As previously described, various different example embodiments of the present general inventive concept may include several different configurations of coupling assemblies used to couple the debris collecting members together. FIG. 15 illustrates a debris collecting member according to still another example embodiment of the present general inventive concept. In the example embodiment illustrated in FIG. 15, a debris collecting member 150 similar to the debris collecting member 110 of FIGS. 11-14 is provided with a different male coupling portion 152. The male coupling portion 152 extends from the top of the bottom portion of the debris collecting member 150 and then curves down before terminating, which allows an easier coupling between the male coupling portion 152 and the female coupling portion 154 of another debris collecting member 150. With such an arrangement, one debris collecting member 150 may easily and readily be slipped onto and off of another debris collecting member 150 without the angling movements described in regard to the example embodiment illustrated in FIGS. 11-14, but still maintain the coupling between the members 150 inside a gutter. Such a male coupling portion 152 may also serve as a handle for gripping during an installation/removal procedure. As can be seen in FIG. 15, the male and female coupling portions 152,154 may provide easier joining and separation, but may not be as secure during such joining and separation, than that provided by the male and female coupling portions 112,114 illustrated in FIG. 11.

According to various example embodiments of the present general inventive concept, the gutter cleaning system may include interior porous channels, or debris collecting members, which are sufficiently smaller than the existing gutter such that the channels are able to be easily inserted and removed from the gutter. In various example embodiments the interior porous channels may be configured in lengths of two to three feet or smaller, and may be coupled to one another by slip fasteners. A selectively openable end cap may be attached at an end of the gutter, such as by pop rivets or screws, and would allow for the easy removal of the porous channels to clean out the debris. The end cap may be configured with a groove to hold a rubber gasket to seal the end cap to the gutter. In a case in which the gutter has inside miters or outside miters, the debris collecting members could be made smaller in length to accommodate the required length. If a leaf guard is present, a porous channel of smaller diameter openings may be more effective. If no leaf guard exists on the gutter, a porous channel of larger diameter openings may allow more efficient flow of liquid in the gutters.

In various example embodiments of the present general inventive concept, plastic or aluminum porous members may be used as the debris collecting members. A handle may be provided at one or both ends of the debris collecting members to allow for more leverage when extracting the debris collecting members. In various example embodiments the end cap could be fixed at one or more hinge locations with pop rivets or screws with a water seal or gasket made of formed rubber, soft plastic, or the like. The fastener on the bottom or front may include a flexible fastener on a hinge with a permanent stud on the bottom of side of the gutter. In various example embodiments, a corner module having adjacent selectively openable end caps may be provided in order to provide selectively openable end caps on a corner section of a gutter. In such a configuration, rubber gaskets may be provided at each end of the corner module meeting the gutter, as well as with the adjacent end caps. In various example embodiments, the adjacent end caps may seal to one another with a common gasket at the exterior corner.

According to various example embodiments of the present general inventive concept, a method of providing access to a gutter may include detaching a previously fixed end portion from the gutter, providing a seal between the previously fixed end portion and the gutter, and coupling the previously fixed end portion to the gutter so as to be selectively openable, i.e., positionable between a closed state and an open state. The previously fixed end portion may be coupled to the gutter by at least one hinged structure. The method may further include a fastening structure to maintain the closed state.

According to various example embodiments of the present general inventive concept, a rain gutter may include a section of gutter configured to collect and divert water, and a selectively openable end cap provided at an end of the section of gutter that is configured to be selectively positionable between a closed state and an open state to access an interior of the section of gutter. The selectively openable end cap may be configured to be secured to the end of the section of gutter by fitting over or inside the end of the section of gutter, and to be completely removed from the end of the section of gutter in the open state. The rain gutter may further include a seal between the selectively openable end cap and the end of the section of gutter to prevent water from escaping between the end cap and gutter. In various example embodiments, such a seal may be formed with a gasket, plumber's putty, silicone sealant, or any other types of sealants or combinations thereof. The end cap may be configured to be secured to the end of the section of gutter by a slip fit. The rain gutter may further include one or more corresponding pairs of mating protrusions and recesses provided to the end cap and the end of the section of gutter to secure the end cap in the closed state. The selectively openable end cap may be configured to be coupled to the end of the section of gutter by at least one hinged structure such that the end cap remains coupled to the gutter in both the open and closed state. The rain gutter may further include a fastening member provided to the end cap and/or the end of the section of gutter to selectively secure the end cap to the end of the section of gutter. The fastening member may include a protruding body provided to one of the end cap and the end of the section of gutter, and a corresponding receiving body provided to the other of the end cap and the end of the section of gutter.

According to various example embodiments of the present general inventive concept, a system to clean a rain gutter may include a plurality of debris collecting members configured fit inside a gutter and to be selectively inserted and removed from the gutter in a sliding manner, wherein each of the debris collecting members is configured to be coupled to another of the debris collecting members such that an entirety of coupled debris collecting members may be moved along the gutter by force applied to one end of the coupled debris collecting members. At least a portion of each of the debris collecting members may be formed in a porous configuration to allow water to move through the debris collecting members while debris is retained inside the debris collecting members. The debris collecting members may be formed with a rigid material so as to be non-pliable. At least a portion of each of the debris collecting members may be formed with a pliable mesh to conform to an inner structure of the gutter. Each of the debris collecting members may be configured with two side portions and two end portions extending from a top of the debris collecting members. Each of the debris collecting members may be configured with two side portions extending from a bottom portion, and openings at both ends that are formed to be coupled other debris collecting members. Each of the debris collecting members may include a male coupling portion at a first end, and a female coupling portion at a second end, such that the female coupling portion of a first debris collecting member is configured to receive the male coupling portion of a second debris collecting member to couple the first and second debris collecting members to one another. The male coupling portion may extend from the debris collecting member and include at least one bend before a distal end of the male coupling portion that is configured to enter the female coupling portion. Each of the debris collecting members may be formed with one or more runner protrusions extending from one or more surfaces of the debris collecting member that are configured to face the gutter, the one or more runner protrusions configured to form an opening between the gutter and debris collecting member and to act as a sliding member on which the debris collecting member slides when being installed and/or removed from the gutter. The one or more runner protrusions may be formed as a plurality of rails extending from a bottom of the debris collecting members. The debris collecting members may be configured to be stackable in a nested arrangement.

According to various example embodiments of the present general inventive concept, a system to clean a rain gutter may include a selectively openable end cap provided at an end of a gutter that is configured to be selectively positionable between a closed state and an open state to access an interior of the gutter, and a plurality of debris collecting members configured fit inside the gutter and to be selectively inserted and removed from the gutter in a sliding manner, wherein each of the debris collecting members is configured to be coupled to another of the debris collecting members such that an entirety of coupled debris collecting members may be moved along the gutter by force applied to one end of the coupled debris collecting members.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams, drawings, and photographs included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, photographs, and claims herein are to be regarded as illustrative in nature, and not as restrictive, and additional embodiments will readily appear to those skilled in the art upon reading the above description and drawings.

Additional modifications will readily appear to those skilled in the art. Accordingly, departures may be made from such details without departing from the spirit or scope of applicant's general inventive concept.

The invention claimed is:

1. A system to clean a rain gutter, comprising:

a plurality of debris collecting members positioned inside a gutter and configured to be selectively inserted and removed from the gutter in a sliding manner, the debris collecting members being formed with a bottom portion and two side portions respectively extending upward from each side of the bottom portion to collect debris therein, one of the side portions extending upward and outward from the bottom portion at a greater angle;

wherein each of the debris collecting members is configured to be coupled to another of the debris collecting members through interaction of male and female coupling portions respectively provided at opposite ends of each of the debris collecting members such that an entirety of coupled debris collecting members are configured to be selectively pushed and pulled along the gutter by force applied to one end of the coupled debris collecting members, and wherein the male coupling portion extends outwardly from a first end of each of the debris collecting members, and the female coupling portion is inwardly offset from a second end of each of the debris collecting members.

2. The system of claim 1, wherein at least a portion of each of the debris collecting members is formed in a porous configuration to allow water to move through the debris collecting members while debris is retained inside the debris collecting members.

3. The system of claim 1, wherein the debris collecting members are formed with a rigid material so as to be non-pliable.

4. The system of claim 1, wherein at least a portion of each of the debris collecting members if formed with a pliable mesh to conform to an inner structure of the gutter.

5. The system of claim 1, wherein each of the debris collecting members are configured with two side portions and two end portions extending from a top of the debris collecting members.

6. The system of claim 1, wherein each of the debris collecting members are configured with openings at both ends.

7. The system of claim 1, wherein the male coupling portion extends from the debris collecting member and includes at least one bend before a distal end of the male coupling portion that is configured to enter the female coupling portion.

8. The system of claim 1, wherein each of the debris collecting members are formed with one or more runner protrusions extending from one or more surfaces of the debris collecting member that are configured to face the gutter, the one or more runner protrusions configured to form an opening between the gutter and debris collecting member and to act as a sliding member on which the debris collecting member slides when being installed and/or removed from the gutter.

9. The system of claim 8, wherein the one or more runner protrusions are formed as a plurality of rails extending from a bottom of the debris collecting members.

10. The system of claim 1, wherein the debris collecting members are configured to be stackable in a nested arrangement.

11. A system to clean a rain gutter, comprising:

a selectively openable end cap provided at an end of a gutter that is configured to be selectively positionable between a closed state and an open state to access an interior of the gutter; and a plurality of debris collecting members configured fit inside the gutter and to be selectively inserted and removed from the gutter in a sliding manner, the debris collecting members being formed with a flat bottom portion and two side portions respectively extending upward from each side of the bottom portion to collect debris therein, one of the side portions extending upward and outward from the bottom portion at a greater angle to increase proximity to a front wall of the gutter;

wherein each of the debris collecting members is configured to be coupled to another of the debris collecting members through interaction of male and female coupling portions respectively provided at opposite ends of each of the debris collecting members such that an entirety of coupled debris collecting members are configured to be selectively pushed and pulled along the gutter by force applied to one end of the coupled debris collecting members;

wherein the male coupling portion extends outwardly from a first end of each of the debris collecting members, and the female coupling portion is configured as an open space formed in and inwardly offset from a second end of each of the debris collecting members, the male coupling portion having a distal end that is curved to enter the female coupling portion.

* * * * *